United States Patent [19]

Sugioka

[11] 4,135,438

[45] Jan. 23, 1979

[54] DEVICE FOR ROUGHENING THE EDGE SURFACE OF A PLURALITY OF SHEETS

[76] Inventor: Yasuji Sugioka, 74, Kitahigashino-cho, Nishihichijo, Shimogyo-ku, Kyoto, Japan 600

[21] Appl. No.: 788,690

[22] Filed: Apr. 18, 1977

[30] Foreign Application Priority Data

Apr. 27, 1976 [JP] Japan ..... 51-52655[U]

[51] Int. Cl.[2] ..... B26D 3/08

[52] U.S. Cl. ..... 93/1 G; 33/185 R; 90/15 R; 407/38

[58] Field of Search ..... 11/1 ET, 1 AD; 90/15 R; 93/1 G, 58 ST; 29/105 A; 407/36, 38; 33/185 R, 201, 168 R

[56] References Cited

U.S. PATENT DOCUMENTS

| | | | |
|---|---|---|---|
| 574,063 | 12/1896 | Hoppes | 90/15 |
| 2,633,582 | 4/1953 | French | 11/1 AD |
| 3,188,667 | 6/1965 | Blair | 11/1 ET |
| 3,662,473 | 5/1972 | Ito et al. | 33/185 R |
| 3,839,772 | 10/1974 | Shimomura et al. | 407/36 |

*Primary Examiner*—James F. Coan

*Attorney, Agent, or Firm*—Christensen, O'Connor, Johnson & Kindness

[57] ABSTRACT

Device for roughening the edge surface of a plurality of sheets to be bound into a book, in which the sheets are clamped, with one edge surface thereof facing a rotatable cutter, which is moved along the length of the edge surface while the cutter is rotated so that the blade traverses the edge surface thereby producing successive arcuate scores in the edge surface. When adhesive is applied to the edge surface, the cuts or scores help provide a stronger binding force than if the edge surface were flat.

9 Claims, 7 Drawing Figures

DEVICE FOR ROUGHENING THE EDGE SURFACE OF A PLURALITY OF SHEETS

This invention relates to a device for roughening the edge surface of a plurality of piled sheets to be bound into a book.

When a plurality or group of piled sheets of paper or the like are to be bound into a book by using adhesive, it is customary to roughen or render rugged the edge surface of the sheets to which adhesive is to be applied so as to increase the force with which the sheets are bound together. Roughening has hitherto been conducted by forming V- or W-shaped grooves on the edge surface of the sheets to be bound widthwise thereof, so that adhesive applied to the edge surface enters the grooves to increase the areas of adhesion and consequently the binding strength of the adhesive.

To form such grooves a disk saw has been used, and a high torque has been required to rotate the saw to cut or engrave the edge surface of the sheets to be bound together. If a rotating drum is used to apply adhesive to such a roughened edge surface of the book, it is likely that the adhesive does not enter sufficiently deeply into the grooves unless a large amount of adhesive is applied to the circumferential surface of the rotating drum. Moreover, the drum must be strongly pressed onto the edge surface of the sheets. Thus, conventional roughening devices have the disadvantage that a great torque is required to rotate the cutter and that the operation of applying adhesive to the roughened edge surface of the sheets is troublesome.

Accordingly, it is one object of the invention to simplify the operation of roughening the edge surface of a plurality of sheets to be bound into a book.

Another object of the invention is to provide a device for roughening the edge surface of the sheets which can increase the strength with which the sheets are bound together.

Another object of the invention is to provide a device for roughening the edge surface of the sheets which can increase the binding strength provided by adhesive.

Still another object of the invention is to provide such a roughening device as aforsaid in which the depth of the roughening can easily be set to a desired value.

According to the invention, a plurality of sheets to be bound into a book are clamped and held at a pedetermined position, and a rotating blade holding base or disk on which a scoring blade is provided is moved along one edge surface of the clamped sheets. As the blade holding base is moved, the rotating blade cuts or scores the edge surface of the clamped sheets. The blade traces circular arcs widthwise of the edge surface of the clamped sheets. One rotation of the blade holding base produces two arcuate cuts or scores oppositely curved. In other words, if during one half rotation of the base the blade moves from left to right over the edge surface of the clamped sheets, leaving thereon a score of a circular arc curved in one direction (upwardly convex in the figure), during the succeeding one half rotation of the base the blade moves oppositely from right to left over the edge surface, leaving thereon another score of a circular arc curved in the opposite direction (downwardly convex in the figure) and spaced apart from the previous score a distance nearly equal to the diameter of rotation of the blade.

Since the blade holding base and the clamped sheets are moved relative to each other, successive pairs of oppositely arcuate scores or cuts are formed in the edge surface of the clamped sheets along the length thereof.

When the blade cuts or scores the edge of each of the clamped sheets, the blade deflects the portions of the edge adjacent to where the blade contacts the edge laterally in the direction of movement of the blade thereby producing a V-shaped cut or score deformation in the edge. As the scoring operation proceeds, there are formed in the edge of each of the clamped sheets along the length thereof many successive V-shaped cuts or deformations having their apexes alternately oppositely directed.

The scores or deformations formed in each of the clamped sheets engage with those in the adjacent sheets, so that it becoms difficult to separate the sheets. This means that the scores or deformations have now produced a strong binding force in the edge of the clamped sheets.

Since the scores or cuts render the edge surface of the sheets rugged, adhesive applied to the rugged edge surface works more effectively thereby to provide a stronger adhesion or binding force than otherwise. Scores or cuts about 0.7 to 1 mm deep suffice for the purpose of the invention.

Unlike in the prior art, mere formation of scores or cuts to such a relatively small depth as mentioned above suffices so that a smaller torque is required to rotate the scoring blade than that required in the prior art to rotate a disk saw for engraving.

No such dust as was produced in the prior art engraving is produced by the mere formation of scores in accordance with the invention.

The invention will be explained in detail with reference to the accompanying drawings, wherein.

Figure 1:
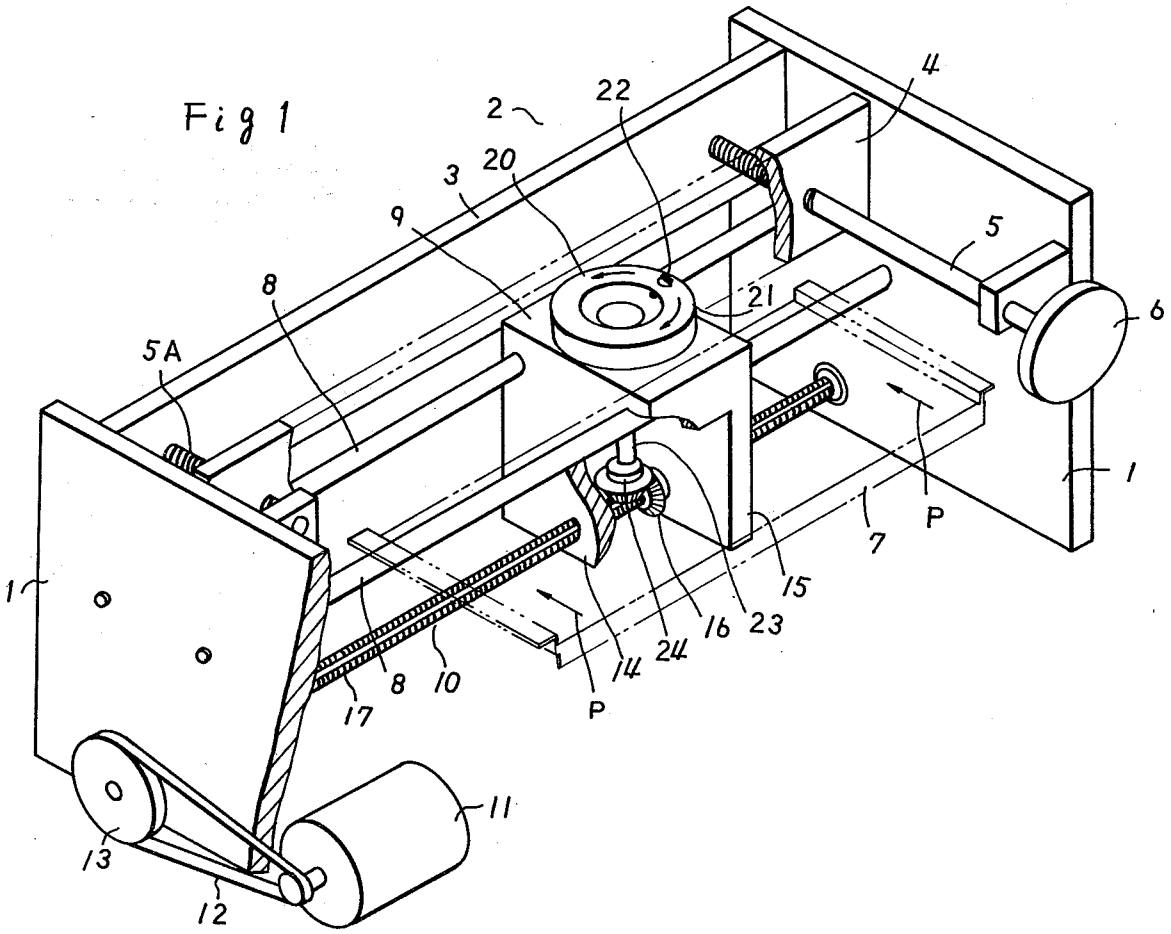
FIG. 1 is a perspective view, partly broken-away, of the roughening device of the invention.
Figure 2:
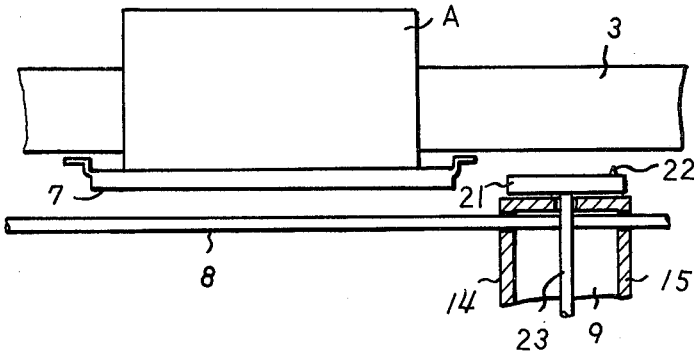
FIG. 2 is a front view, partly in vertical section, of a portion of the device shown in FIG. 1.
Figure 3:
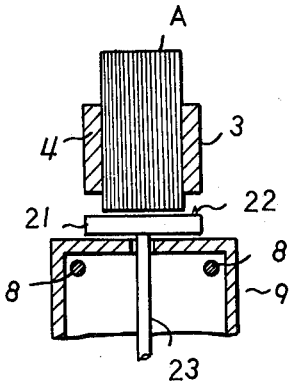
FIG. 3 is a sectional side view of FIG. 2.

Referring to FIG. 1, there is shown a clamping device 2 provided between a pair of side walls 1 of the machine frame. The device 2 comprises a pair of parallel clamping plate members 3 and 4. The clamping member 3 has its opposite ends fixed to the walls 1, and the other clamping member 4 is slidable in parallel with the clamping member 3 toward and away therefrom.

A plurality of sheets A to be bound into a book one edge surface of which is to be roughened are clamped between the two clamping members 3 and 4. The clamping member 4 is moved in accordance with the thickness of the sheets A to be clamped. For moving the clamping member 4 a screw rod 5 is threaded through the clamping member 4 and is provided with a handle 6 at one end thereof. By rotating the screw rod 5 by the handle 6 the clamping member 4 is moved toward or away from the clamping member 3 in parallel therewith. For smooth parallel movement of the clamping member 4 another screw rod 5A may be threaded through the clamping member 4. The rotation of the screw rod 5 may be transmitted to the screw rod 5A by means of a chain-and-sprocket connection (not shown) for simultaneous rotation of the two rods.

A sheet arranging table 7 is provided below the clamping members 3 and 4 so that the table 7 is slidable in the direction of an arrow P. Prior to the start of operation, the table 7 is moved to a predetermined vertical position below the clamping members 3 and 4. The piled sheets or book A are arranged on the table 7 so that the edge surface of the sheets or book to which adhesive is to be applied becomes flat on the table. Then, the sheets A are clamped together between the clamping members 3 and 4 as described above. The edge surface of the clamped sheets or book A (to which adhesive is to be applied) is held at the predetermined position since the table 7 is kept at the fixed vertical position. In other words, the edge surface of the book A is always maintained at a fixed distance from the under surface of the clamping member 3 and 4. After the sheets A have been clamped in the above manner, the table 7 is returned to the original position.

Below the clamping device 2 a pair of horizontal guide rods 8 are provided between the two walls 1. A scoring unit 9 is mounted on the guide rods so as to be slidable therealong. Between the frame walls 1 a screw rod 10 is rotatably supported. The rod 10 is rotated by a motor 11 through a belt 12 and a pulley 13. Preferably, the motor 11 is a reversible motor so as to be able to rotate the screw rod 10 in both directions.

The rod 10 is threaded through one of the side walls 14 and 15 of the scoring unit 9, so that upon rotation of the rod 10 the scoring unit 9 moves along the guide rods 8.

A bevel gear 16 is rotatably mounted on the other wall 15 of the scoring unit 9, so that as the scoring unit 9 moves, it carries the bevel gear 16 along therewith. The screw rod 10 passes through an axial bore of the bevel gear 16. A key fixed to the axial bore of the bevel gear 16 engages in an axial key way 17 formed on the screw rod 10, so that the bevel gear 16 is rotated by the rotation of the screw rod 10 while it is moved along the rod 10.

A scoring device 20 is provided on the top face of the scoring unit 9. The device 20 comprises a blade holding base 21 and a blade 22 mounted thereon. Rotation of the base 21 causes the blade 22 to rotate and cut or score the edge surface of the clamped sheets A. The blade 22 does not cut off any portion of the sheets but simply scores the edge surface thereof. The blade preferably is double-edged, so that upon roation of the blade holding base in either direction the blade can score the edges of the sheets A.

A rotatable vertical shaft 23 is passed through the top wall of the scoring unit 20 and has its upper end fixed to the base 21. The rotatable shaft 23 is provided at its lower end with a bevel gear 24 which meshes with the bevel gear 16. Accordingly, the rotation of the screw rod 10 is transmitted to the shaft 23 through the bevel gears 16 and 24 so that the base 21 is rotated.

The rotation of the bevel gear 24 may be transmitted to the shaft 23 indirectly through additional gears. Alternatively, the base 21 may be rotated by a different drive source, independently of the rotation of the screw rod 10.

Figure 6:
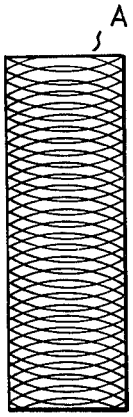
FIG. 6 is a plan view of the edge surface of the sheets with arcuate scores formed thereon.

In operation, as the scoring unit 9 is moved along the guide rods 8 the base 21 rotates and the blade 22 scores the edge surface of the clamped sheets A. The scores on the edge surface are shown as a plurality of circular arcs in FIG. 6, which is a plan view of the edge surface of the clamped sheets. In FIG. 6 the arcs of the scores are formed, with the longitudinal center line of the edge surface of the sheets A coinciding with the axis of rotation of the base 21. However, such coincidence is not essential, but the axis of rotation may be displaced from the center line. Since the width of the edge surface of the clamped sheets A varies with the thickness of the sheets, while the locus of the axis of rotation of the base 21 remains the same, the above-mentioned coincidence does not always take place.

Figure 7:
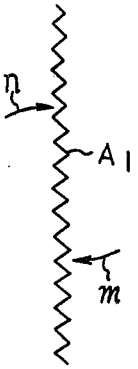
FIG. 7 is an end view of one of the sheets shown in FIG. 6.

Let one sheet $A_1$ be taken out of the clamped sheets A for a closer look at the cut or scored edge thereof. When the blade 22 moves in the direction of an arrow m and cuts the edge of the sheet $A_1$ as shown in FIG. 7, that portion of the edge of the sheet $A_1$ adjacent to the point where the blade contacts the edge is pushed by the blade in the direction of the arrow m to produce a V-shaped score or deformation the valley point of which is formed by the cut portion. After a half rotation, the blade 22 comes in the opposite direction indicated by an arrow n and cuts the portion of the edge of the sheet $A_1$ spaced from the previously cut portion at a distance nearly equal to the diameter of rotation of the blade to produe a similar V-shaped score or deformation.

The above operation is repeated as the rotational axis of base 21 moves longitudinally of the edge surface of the sheets A, so that there are formed many V-shaped scores alternately oppositely directed as shown in FIG. 7. Due to the V-shaped scores, the scored edges of adjacent sheets engage with each other. Because of this engagement of the scored edges of the sheets, each sheet $A_1$ cannot easily be separated from the adjacent one. This means that a strong binding force has been given to the sheets.

Adhesive is then applied to the scored edge surface of the sheets to bind the edges thereof. Since the edge surface has been roughened by the small scores, the adhesive penetrates into the scores in the edge surface so as to produce a stronger adhesive force than otherwise. It is obvious that the increase in the adhesion, that is, in the binding force has been partly caused by the previously described engagement of the scored edges of the sheets with each other. Experiments have disclosed that the binding strength obtained by the method of the invention is three times greater than that attained by the conventional method by which adhesive is applied to the plane edge surface of the sheets, and that with V-shaped grooves the binding strength is about one and a half times greater than that attained by the conventional method.

Figure 4:
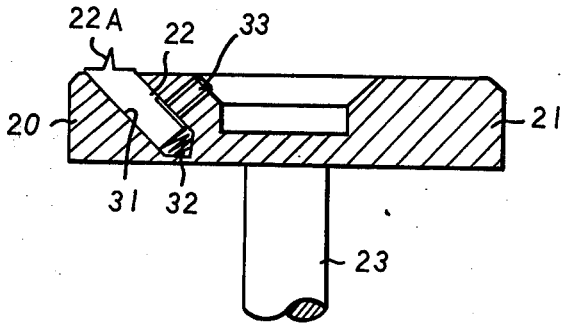
FIG. 4 is an enlarged sectional view of the scoring blade.

As shown in FIG. 4 the blade 22 is fixed to the base 21. A slant bore 31 is formed in the periphery of the base 21. A spring 32 is put in the bottom of the slant bore 31 and the blade 22 is pushed into the bore 31 against the resiliency of the spring 32. The blade 22 is fixed in the bore by a set screw 33 so that its blade edge 22A projects to a predetermined height from the top surface of the base 21. When the blade 22 is to be replaced by another one or the height of the blade edge 22A is to be adjusted, the screw 33 may simply be loosened, whereupon the blade 22 is pushed upwardly by the resiliency of the spring 32, so that the blade 22 can easily be taken out of the bore, or with the blade at a desired position or height the screw 33 may be fastened so as to hold the blade at the position.

Figure 5:
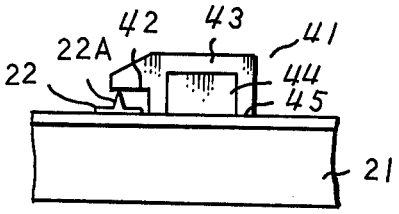
FIG. 5 is an enlarged elevational view of the blade holding base, showing the manner in which the position of the blade is set.

For adjustment of the height of the blade edge 22A of the new blade, a setting gauge 41 as shown in FIG. 5 is preferably used. The setting gauge 41 comprises a gauge frame 43 having a reference surface 42 and a magnet 44.

In setting operation, the under surface 45 of the gauge 41 is placed on the upper surface of the base 21, with the reference surface 42 of the gauge frame 43 being in contact with the tip of the blade edge 22A of the new blade, whereupon the gauge frame 43 is fixed to the upper surface of the base 21 by the attractive force of the magnet 44. Then, the screw 33 is fastened to fix the blade 22 to the bore 31. Since the distance between the under surface 45 of the gauge frame 43 and the reference surface 42 is constant, the distance between the upper surface of the base 21 and the tip end of the blade edge 22A, that is, the height of the blade edge 22A can always be kept constant. By using different gauges having different distances between the under surface 45 of the gauge frame 43 and the reference surface 42, it is possible to set the blade edge 22A to different heights.

Thus, according to the invention, the sheets are bound together strongly and the adhesive force provided by adhesive is increased by the scored edge surface of the sheets, so that the binding strength is greatly increased as compared with that attained by the conventional methods. Moreover, the depth of the scores for roughening the edge surface of the bound sheets can always be kept constant.

What I claim is:

1. A device for roughening the edge surface of a plurality of sheets to be bound into a book, comprising: means for clamping said plurality of sheets; a scoring unit comprising a rotatable blade holding base, a scoring blade mounted thereon, and means for rotating said base so that said blade passes repeatedly across said edge surface in pairs of oppositely oriented semicircular arcs that extend widthwise of said edge surface; and means for causing relative movement of said scoring unit to the edge surface of said clamped sheets while said base is rotated so that each complete revolution of said scoring blade makes a pair of oppositely oriented arcuate score deformations in said edge surface, each of which deformations have a V-shape, and wherein the resulting V-shaped edge portions of individual ones of said sheets that together define such deformations are deflected by said scoring blade in one widthwise direction along a first of said pair of arcuate deformations and in the opposite widthwise direction along the other of said pair of arcuate deformations.

2. The device of claim 1, wherein said base is so disposed that said blade faces said edge surface of said sheets clamped by said clamping means and wherein said blade is double-edged and has a tip end, said blade being disposed on said base with said tip end spaced outwardly from said base so as to form the valleys of said V-shaped score deformations, and so that either direction of rotation of said base causes one of the double edges of said blade together with its tip end to make said V-shaped score deformations in said edge surface of said sheets.

3. The device of claim 1, wherein said causing means includes a pair of guide rods extending longitudinally of said edge surface of said clamped sheets, said scoring unit being carried on said guide rods slidably therealong.

4. The device of claim 3, wherein said base is rotated while said scoring unit is moved along said guide rods.

5. The device of claim 1, wherein said causing means includes a drive means which moves said scoring unit relative to said edge surface of said clamped sheets and at the same time rotates said base.

6. The device of claim 1, wherein said scoring unit is disposed below said clamping means, and further including a table selectively movable to and away from a predetermined position below said clamping means and above said scoring unit, so that when said table is at said predetermined position, said table defines the vertical position of said edge surface of said clamped sheets relative to said blade.

7. The device of claim 5, wherein said drive means includes a screw rod, a motor, means for transmitting the rotation of said motor to said screw rod, means for transforming the rotation of said screw rod to the linear movement of said scoring unit, and means for transmitting the rotation of said screw rod to said base.

8. The device of claim 1, wherein said base is formed with a bore into which said blade is inserted and fixed against the resiliency of a spring so that a tip end of said blade projects out of a surface of said base.

9. The device of claim 1, further including a blade positioning gauge provided with a reference surface adapted to be brought into contact with a tip end of said blade and mounting surface adapted to be placed on said surface of said base, the distance between said mounting and reference surfaces defines the height of said cutter blade.

* * * * *

UNITED STATES PATENT AND TRADEMARK OFFICE

CERTIFICATE OF CORRECTION

PATENT NO. : 4,135,438

DATED : January 23, 1979

INVENTOR(S) : Yasuji Sugioka

It is certified that error appears in the above-identified patent and that said Letters Patent are hereby corrected as shown below:

Abstract, line 4, delete "cutter" and insert —scoring blade—.

Abstract, line 5, delete "cutter" and insert —blade—.

Column 1, line 44, delete "aforsaid" and insert -- aforesaid --.

Column 2, lines 56, there should be a comma —,— after "book", line 57, insert a -- , -- after "roughened".

Column 3, line 50, delete "roation" and insert —rotation—.

Column 4, line 26, delete "produe" and insert —produce—.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*